United States Patent [19]

Gallon

[11] 4,375,241

[45] Mar. 1, 1983

[54] DRILLING INSTALLATION, MORE SPECIFICALLY FOR OIL-DRILLING OPERATIONS

[75] Inventor: Jean Gallon, Paris, France

[73] Assignee: Union Industrielle et D'Entreprise, Paris, France

[21] Appl. No.: 42,939

[22] Filed: May 29, 1979

[30] Foreign Application Priority Data

Apr. 11, 1979 [FR] France ..... 7909155

[51] Int. Cl.[3] ..... B23Q 5/027; B23Q 5/033

[52] U.S. Cl. ..... 173/151; 52/115; 52/116; 52/741

[58] Field of Search ..... 173/151; 52/116, 117, 52/118, 119, 126, 741

[56] References Cited

U.S. PATENT DOCUMENTS

| | | | |
|---|---|---|---|
| 3,228,151 | 1/1966 | Woolslayer et al. | 52/116 |
| 3,271,915 | 9/1966 | Woolslayer et al. | 52/116 |
| 3,333,377 | 8/1967 | Woolslayer | 52/116 |
| 3,747,695 | 7/1973 | Branham | 173/151 |
| 3,749,183 | 7/1973 | Branham et al. | 173/151 |
| 3,754,361 | 8/1973 | Branham | 52/116 |
| 3,796,272 | 3/1974 | Branham et al. | 173/151 |
| 3,803,780 | 4/1974 | Donnally | 32/116 |
| 3,807,109 | 4/1974 | Jenkins et al. | 173/151 |
| 3,922,825 | 12/1975 | Eddy et al. | 173/151 |
| 3,942,593 | 3/1976 | Reeve et al. | 173/151 |
| 4,024,924 | 5/1977 | Houck | 173/151 |

FOREIGN PATENT DOCUMENTS

| | | | |
|---|---|---|---|
| 1186006 | 1/1965 | Fed. Rep. of Germany | 52/116 |

*Primary Examiner*—Ronald Feldbaum

*Attorney, Agent, or Firm*—Hubbell, Cohen, Stiefel & Gross

[57] ABSTRACT

This invention concerns a drilling installation comprising a base which rests on the ground, a rig, a winch, items of equipment such as a drill-pipe storage coffer, and a working floor which is raised above the base, surrounding the rig.

The installation is characterized by the fact that it comprises a carrying platform designed to take the rig, and which can be moved from a low position in contact with the base to a high position, and which is connected by a suitable lifting device to lifting uprights attached to the base. The platform also carries the working floor and items of equipment.

The invention more specifically concerns drilling installations for oil-drilling operations.

3 Claims, 3 Drawing Figures

DRILLING INSTALLATION, MORE SPECIFICALLY FOR OIL-DRILLING OPERATIONS

BACKGROUND OF THE INVENTION

Drilling installations for oil-drilling operations commonly involve a very high drilling rig, which is used for handling and storing drill-pipes. These drill-pipes, which are assembled end to end as drilling progresses, are driven by a rotary table, and themselves drive the drilling bit. They are raised and supported by a winch, operating through a block line installed between the crown of the rig and the drill-pipe.

Until now, the drilling rig has been installed and erected by means of a base supporting the drilling winch which is used with a derrick to raise the mast, hinged to the base. This same winch, supported by an articulated parallelogram device, is then raised above the base and used to install a working floor, also raised above the base and consisting of removable components carried on girders stretching from the winch to a drill-pipe storage container which rests on the base and is also installed by the winch.

Installation operations are quite long and therefore costly. They also have to be repeated every time the installation is moved.

This invention concerns a new drilling installation which is particularly convenient and quick to erect. This ease of erection makes the invention extremely labour- and time-saving.

This new drilling installation, comprising a base resting on the ground, a rig, a winch, items of equipment such as a drill-pipe storage coffer, and a working floor which is raised above the base, surrounding the rig, is characterized by the fact that it includes a carrying platform designed to take the mast and which can be moved from a low position in contact with the base to a high position, this platform being connected by a suitable lifting device to raising uprights attached to the base, the said platform also supporting the working floor and items of equipment.

The raising uprights lift the platform by means of racks which connect with pinions on the platform, the system being driven by a reduction unit.

This means that when the rig has been raised to a vertical position by the normal method, the platform, which preferably forms a single unit with the drilling winch, can be raised to the high position and provide direct support for the working floor.

This saves a considerable amount of time.

Other purposes and benefits of this invention will appear from the following description of one possible embodiment of such an installation, illustrated by the accompanying figures.

DESCRIPTION OF THE PREFERRED EMBODIMENT

In the specimen embodiment shown here, this new drilling installation normally comprises a horizontal base 10, the bottom of which rests on the ground, and a platform 11, formed from girders 12, resting on the base.

Figure 1:
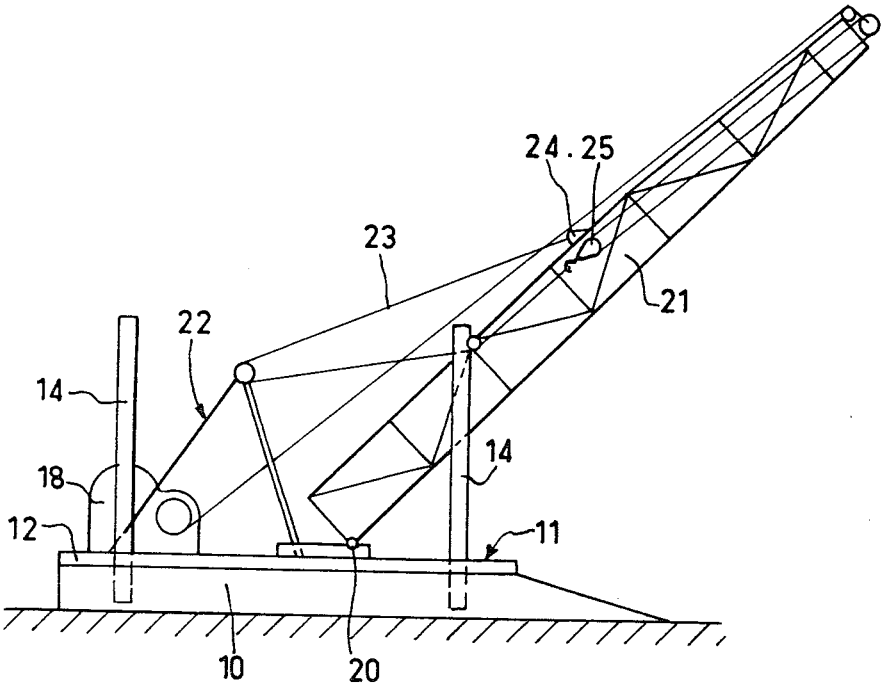
FIG. 1 is a diagrammatical view of this new drilling installation, with the drilling rig in the process of being erected on the working platform, which is in the low position.
Figure 3:
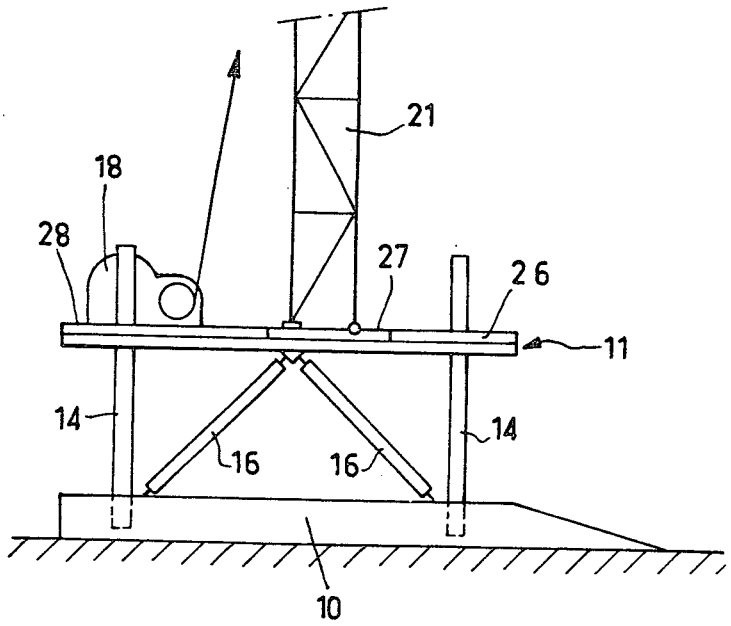
FIG. 3 is another similar view, but with the working platform in the high position.
Figure 2:
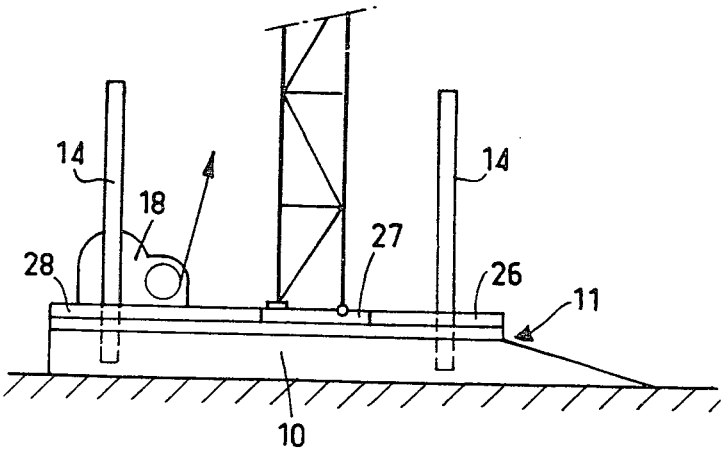
FIG. 2 is a similar view to the one in FIG. 1, with the drilling rig now completely erect on the platform, which is still in the low position but has been fitted with various items of equipment.

The platform 11 is connected to raising uprights 14 on the base 10, and can move from a low position in contact with the base (as shown in FIGS. 1 and 2) to a high position (FIG. 3). Some suitable system, such as a rack-and-pinion device (not shown here) is provided for this purpose, with pinions on the platform, driven by a reduction unit, meshing with rack on the uprights. When it has been raised to the high position, the platform may be wedged to the uprights, and further held in position by means of struts 16 suitably installed between base and platform.

One end of the platform 11 carries a drilling winch 18, and towards the middle there is a hinged mechanism 20 to take the base of the drilling rig 21. The rig is assembled in a horizontal position, then raised in the normal way, using a removable derrick 22 in combination with the winch 18. One end of a raising cable 23 is attached to a point 24 on the rig; the line passes over the derrick and is pulled by the winch 18 through a reeving block 25 between the top of the rig and the other end of the cable. When the rig is erect, it is fixed firmly to the platform 11, and the derrick is then removed.

A working floor is constructed on this platform, consisting of coffer-shaped containers, comprising a drill-pipe storage coffer 26, another 27 at the base of the rig, forming the rotary table, and a coffer 28 carrying the winch 18.

This floor, which is attached to the platform 11, is raised with it, and the drilling rig, on the raising uprights 14, as already described, and is fixed in the upper position (shown in FIG. 3), by means of wedges and struts.

The drilling installation can thereupon come into operation without loss of time, and out time is considerably reduced.

This invention is of course in no way confined to the embodiments described and illustrated here; many variant forms are possible for someone skilled in the art, depending on the purposes for which it is used and without departing from the spirit of the invention.

What is claimed is:

1. A drilling installation comprising a stationary base resting on the ground, a platform vertically movable between a lowermost position wherein it rests on top of said base and an uppermost position wherein it is vertically spaced from said base top, means for raising and lowering said platform with respect to said base, a mast-like drilling rig having a top end and a bottom end, said rig being pivotally mounted at said bottom end on said movable platform for movement between a horizontal resting position and a vertical position wherein it is supported by said platform, a plurality of vertical uprights affixed at their respective lower ends to said base for guiding said platform when it effects its vertical movements between said lowermost and uppermost positions, said platform comprising a unitary rigid supporting structure substantially formed from girders installed when said platform is in said lowermost position, a plurality of coffers adapted to be assembled on said supporting structure in said lowermost position, so as to define a working floor on said platform, one of said coffers comprising a rotary drilling table and another one of said coffers constituting a storage unit for storing drilling equipment items including drill-pipes, an erecting derrick removably mounted on said movable platform, a drilling winch mounted on said movable platform, a reeving block, a rig raising cable connected at one of its ends to said rig and operatively guided by said erecting derrick, the other end of said rig raising cable being removably connected to said reeving block, a winch cable connected to said winch, said reeving block being operatively connected to said drilling winch by said winch cable guided by a guiding pulley at the top end of said mast-like rig and adapted to be actuated by said winch for raising said rig to said vertical position on said movable platform while the same is in said lowermost position by exerting, through said reeving block, a tractional force on said other end of said rig raising cable, thereby moving the rig about the pivotal mounting thereof on said platform.

2. The drilling installation of claim 1, wherein said means for raising and lowering said platform comprises motor driven pinions mounted on said platform and meshing with corresponding racks mounted on said vertical uprights.

3. A method of constructing a drilling installation of the type including a base resting on the ground, a unitary platform mounted on the top of said base, means for vertically raising and lowering said platform relative to said base between a lowermost position in which the platform rests on the base and an uppermost position in which said platform is supported above said base, a mast-like drilling rig supported on said platform and having a top end and a bottom end, a drilling winch mounted on said platform, an erecting derrick removably mounted on said platform, a reeving block, a rig raising cable connected at one end of its ends to said rig and operatively guided by said erecting derrick, the other end of said rig raising cable being removably connected to said reeving block, a winch cable connected to said winch, said reeving block being operatively connected to said drilling winch by said winch cable guided by a guiding pulley at the top end of said mast-like rig, said method comprising the steps of:

forming said platform from a plurality of girders in said lowermost position; pivotally connecting said bottom end of said mast-like drilling rig to said platform in a pre-assembled form and in a substantially horizontal position in relation to said platform, while said platform is in said lowermost position; mounting said drilling winch on said platform while the latter is in said lowermost position; removably mounting an erecting derrick on said platform in the lowermost position thereof; removably attaching to said rig one end of the rig raising cable adapted to be operatively guided by said raising derrick, while removably attaching the other end of said rig raising cable to said reeving block; actuating said winch when said platform is in said lowermost position so as to exert on said other end of said rig raising cable a tractional force through said winch cable and said reeving block attached thereto for erecting said rig to a vertical position and supporting said rig in this position on said platform; thereafter removing said erecting derrick and said rig raising cable, and constructing a working floor on said platform by mounting thereon a plurality of coffers while said platform is in said lowermost position, one of said coffers comprising a rotary drilling table and another one of said coffers comprising a storage unit for drilling equipment including drill-pipes, whereby said drilling installation is assembled so that said platform, drilling rig, winch and coffers are adapted to be displaced integrally between said lowermost and uppermost positions.

* * * * *